United States Patent [19]

Cavanagh

[11] Patent Number: 4,585,041

[45] Date of Patent: Apr. 29, 1986

[54] BAG FILLING APPARATUS

[76] Inventor: Leo J. Cavanagh, 8011 - 60 1/2 Avenue North, New Hope, Minn. 55428

[21] Appl. No.: 672,458

[22] Filed: Nov. 19, 1984

[51] Int. Cl.[4] ..... B65B 1/06

[52] U.S. Cl. ..... 141/231; 141/237; 141/317

[58] Field of Search ..... 141/10, 67, 68, 114, 141/313-317, 234-248, 231-233

[56] References Cited

U.S. PATENT DOCUMENTS

| | | | |
|---|---|---|---|
| 862,231 | 8/1907 | Bates | 141/237 |
| 3,552,346 | 1/1971 | Gordon | 141/72 |
| 3,951,284 | 4/1976 | Fell | 214/152 |
| 4,184,522 | 1/1980 | Waite | 141/231 |

*Primary Examiner*—Houston S. Bell, Jr.
*Attorney, Agent, or Firm*—Leo Gregory

[57] ABSTRACT

A bag filling apparatus attachable to a conveyance comprising a hopper having in connection therewith a plurality of bag filling chutes and including structure to selectively or simultaneously control the openings of the chutes.

1 Claim, 6 Drawing Figures

BAG FILLING APPARATUS

BACKGROUND OF THE INVENTION

1. Field of Invention.

This apparatus relates to a bag filling apparatus.

2. Description of the Prior Art.

In U.S. Pat. No. 3,552,346 to Gordon, a hopper is shown having a plurality of hand controlled chute for individually filling hand supported bags.

In U.S. Pat. No. 4,184,522 to Waite there is shown a trailer mounted assembly having an auger feeding a hopper and having bag filling nozzles mounted to rotate into a bag filling position under a bag filling chute.

It is desirable to have a bag filling arrangement adapted to accommodate a plurality of bags which may be filled simultaneously or on a selective basis.

SUMMARY OF THE INVENTION

The invention herein represents improvement over prior art structures as known.

It is an object of this invention to provide an apparatus arranged to fill a plurality of bags as with sand whereby a number of bags can be filled at one time automatically and the bag filling process can be controlled by a common control or by individual controls as may be desired.

It is another object of this invention to provide a bag filling apparatus wherein the hopper thereof has a plurality of bags mounted onto chutes and a common plate member is arranged to control the passages to said chutes or in the alternative said chutes may be individually controlled.

It is a further object of this invention to provide a hopper having a plurality of chutes adapted to have bags mounted thereon wherein a lesser number than all of said chutes may be made operative and the bags filled may be controlled by a single shut off member.

These and other objects and advantages of the invention will be set forth in the following description made in connection with the accompanying drawings in which like reference characters refer to similar parts throughout the several views.

DESCRIPTION OF A PREFERRED EMBODIMENT

The bag filling structure herein is preferably intended for use in filling sand bags quickly, such as in flood areas. The structure as described herein is hung onto the tailgate as of a dump truck but in other embodiments the structure may be free standing and have the hopper filled.

Figure 1:
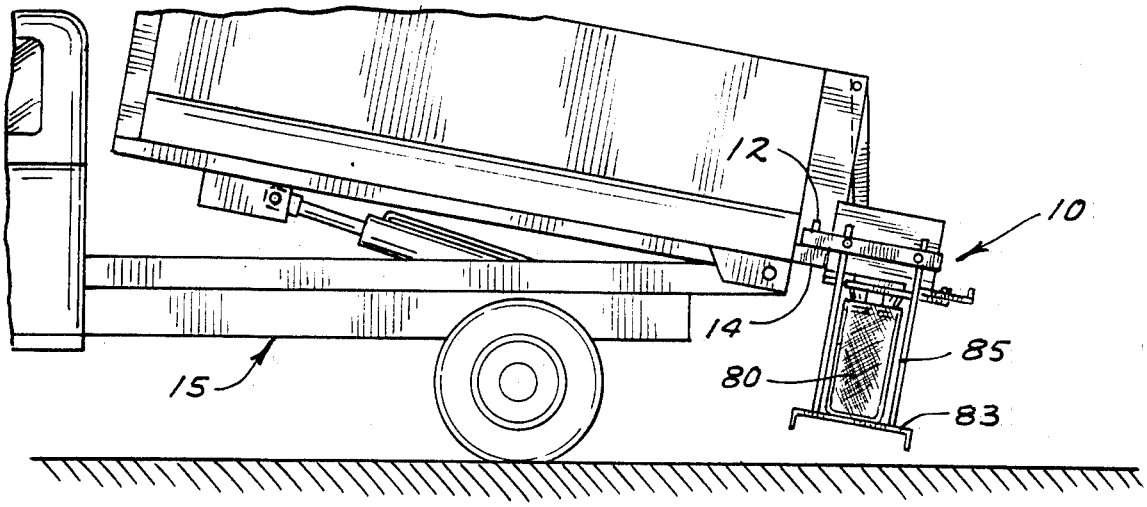
FIG. 1 is a view in side elevation of the structure herein in an operating position.
Figure 2:
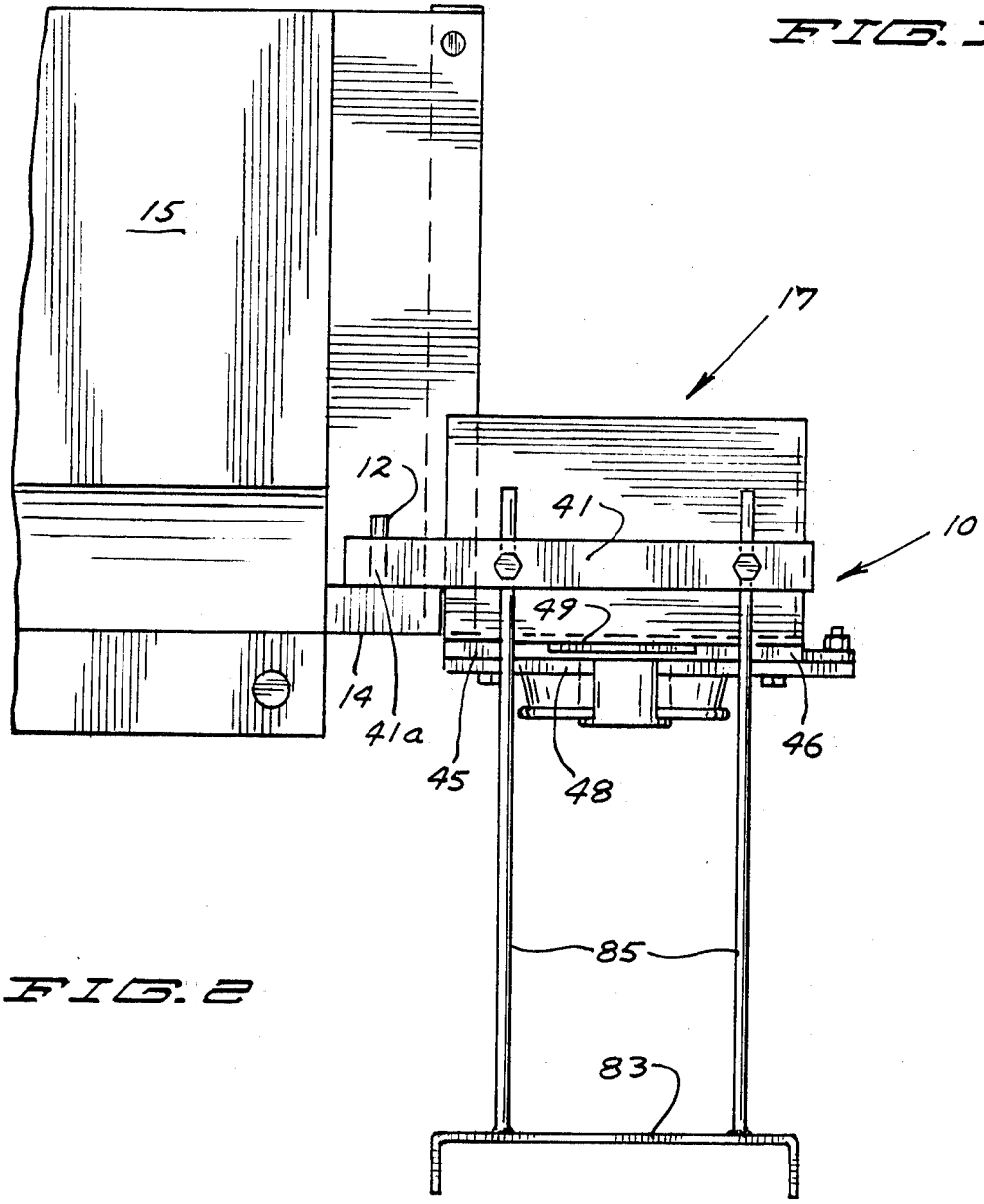
FIG. 2 is a view similar to that of FIG. 1 on an enlarged scale.
Figure 3:
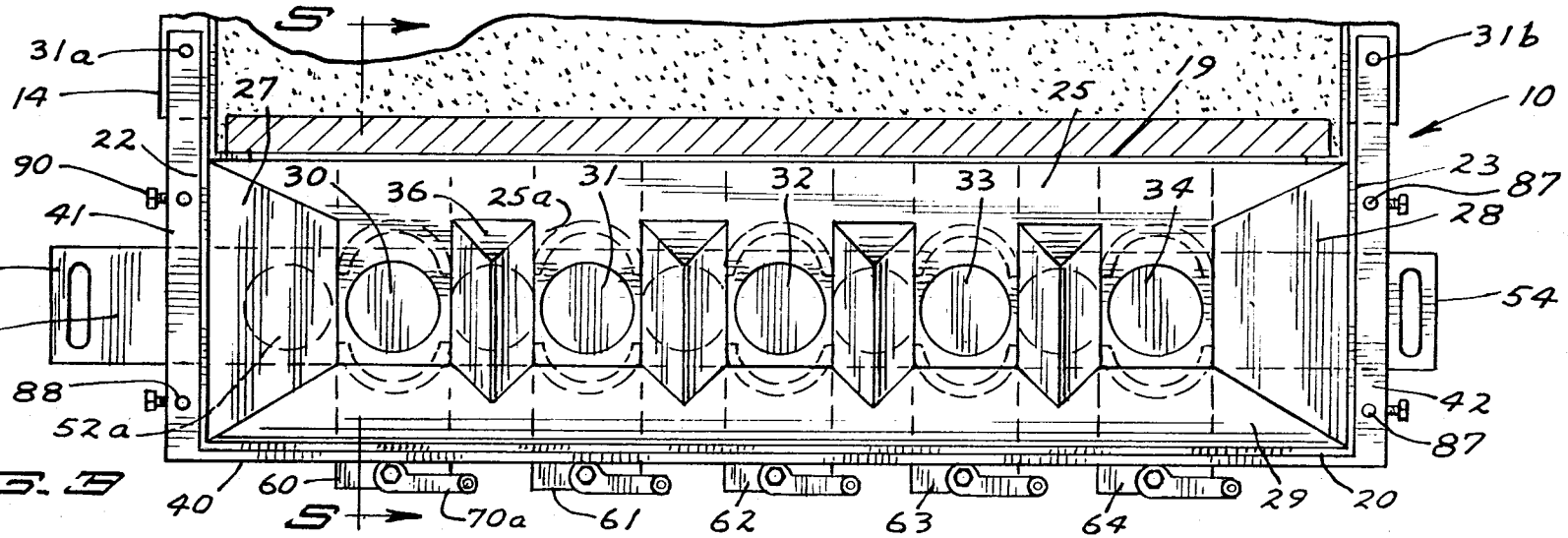
FIG. 3 is a top plan view.
Figure 4:
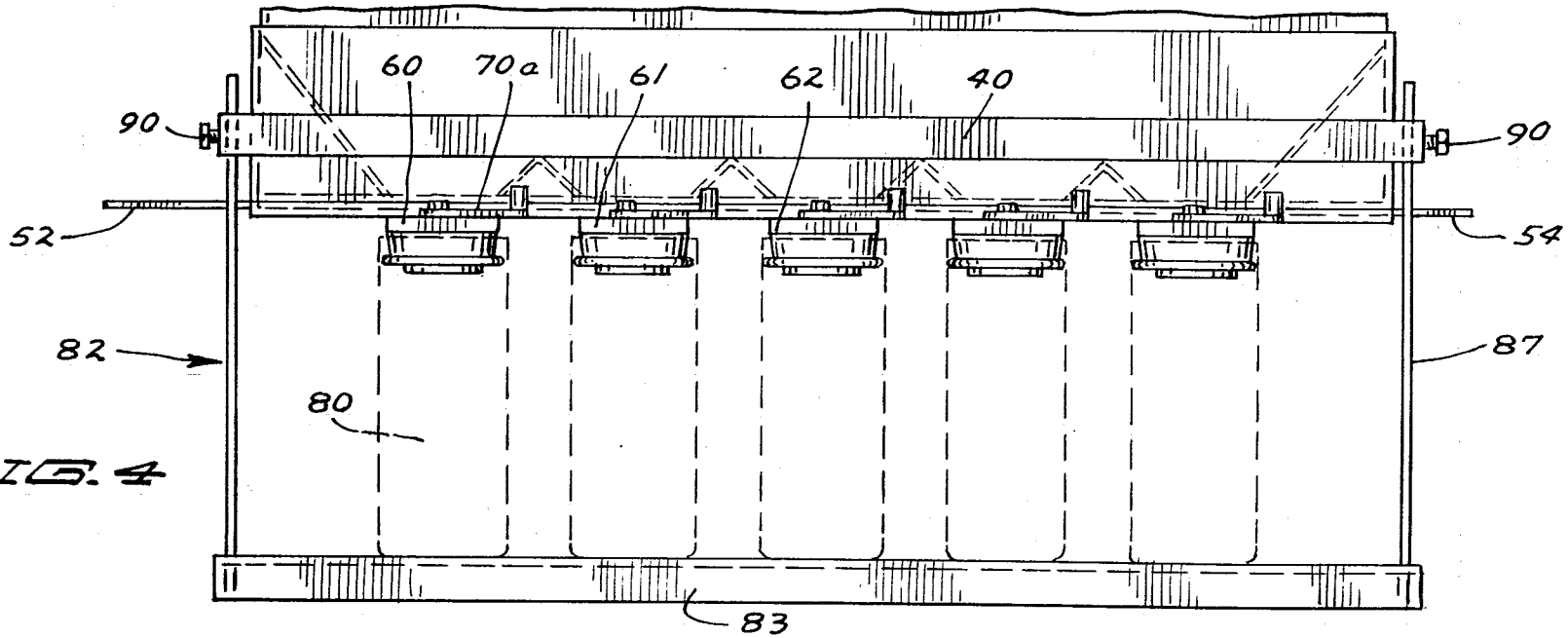
FIG. 4 is a view in end elevation showing some portions in dotted line.
Figure 5:
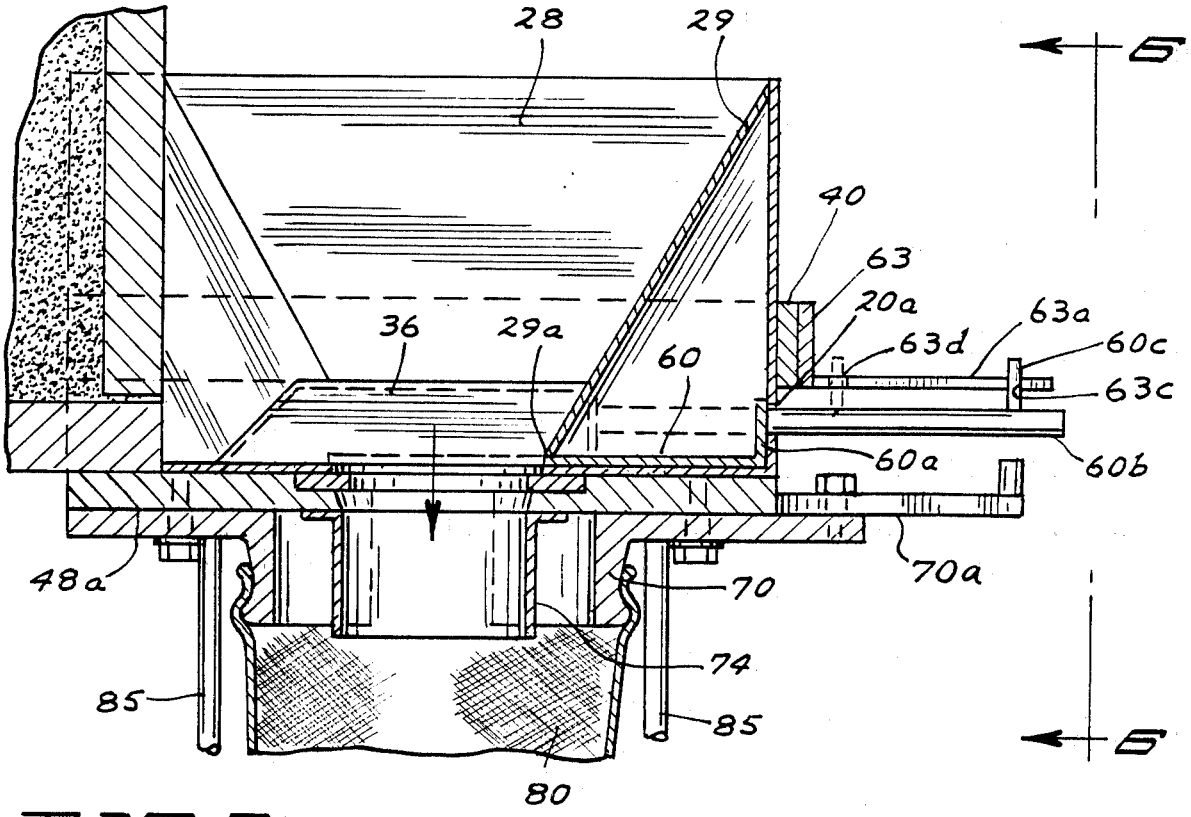
FIG. 5 is a view in vertical cross section taken on line 5—5 of FIG. 3 as indicated.
Figure 6:
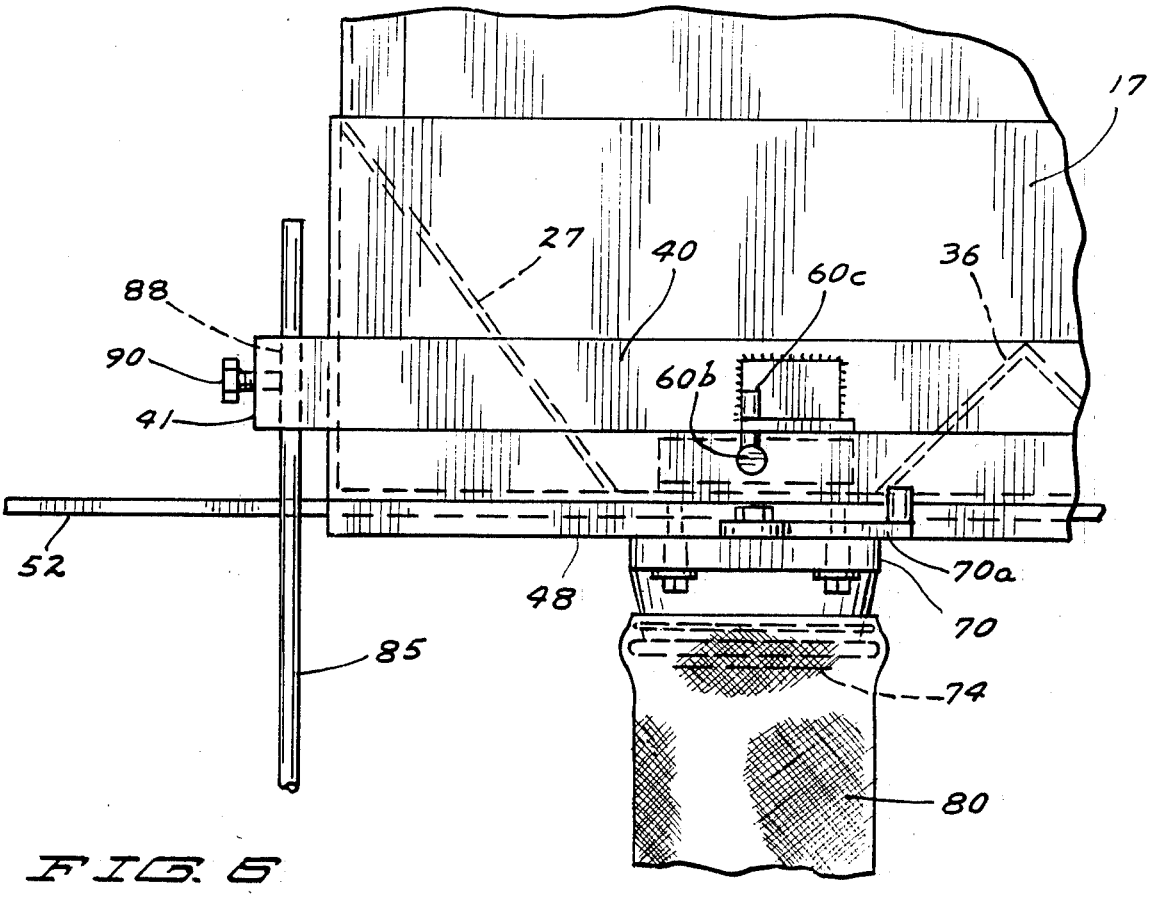
FIG. 6 is a fragmentary view in front elevation taken on line 6—6 of FIG. 5 as indicated.

With reference to the drawings, the structure comprising the invention herein is indicated generally by the reference numeral 10 and is shown in FIG. 1 and indicated in FIG. 2 as being mounted onto conventional mounting brackets 12 carried on the tailgate 14 of a truck 15.

Said structure 10 comprises a hopper 17 substantially rectangular in cross section and having a length which corresponds to the width of a conventional dump truck. Said hopper has side walls 19 and 20 and end walls 22 and 23 and having a bottom wall 25.

Said hopper is shown having inboard downwardly inclined end walls 27 and 28 and a downwardly inclined side wall 29 adjacent the outer side wall 20. The side wall 19 which will be adjacent the dump truck body will be tilted in operation and hence no inclined inner wall is required. Said inclined walls serve as deflection plates.

The inclined end walls 27 and 38 define therebetween a substantially rectangular base portion **25*a* through which are formed openings 30–34 of which the opening 30 and its related working parts will be described as representative of the others. Said holes are spaced longitudinally between said end walls 27 and 28 and deflection plates as represented by the plate members 36** are formed upstanding between said holes. Said deflection plate members are conventionally formed as being of an inverted V-shape in cross section.

Extending along the outer wall 20 of said hopper is a frame member 40, the same being connected to two end frame members 41 and 42 secured to the end walls 22 and 23. Said end frame members respectively extend beyond the side wall 19. The extended portions of said end frame members are appropriately apertured as at **41*a* or otherwise formed as brackets to be disposed onto said pins 12 to be mounted onto the tailgate 14 of said truck 15**.

Underlying said hopper in transversely spaced relation and extending the full length thereof are board members 45 and 46 underlying which is a unitary bottom support member 48. Thus the space 49 between the boards 45 and 46 forms an open top slot into which is disposed an elongated board member 52 extending outwardly of each end of said hopper with handle portions 53 and 54 thereof. Said handle portions are formed by slotting said ends as illustrated. Though not here shown said board 52 may be provided with rollers or bearing guides at each side thereof, all within the concept herein.

Said board member 52 is apertured to have holes therein as represented by **52*a* which with the board in one position will be aligned with the holes 30–34—said holes being spaced apart just slightly more than their diameters. Thus by pulling said board 52 outwardly all of its said holes become misaligned with said holes 30–34** and in an alternate position said holes are respectively aligned.

Extending transversely of said hopper 17 to overlie said board 52 and to underlie said holes 30–34 are cross board or transverse cover plate members 60–64 of which the member 60 will be further described as representative of the remainder.

Said plate member 60 has an end wall **60*a* and a handle 60*b* extending outwardly of the side wall 20 through a slot 20*a* therein, said handle has a pin stop member 60*c* upstanding from adjacent the end thereof. Said inclined wall 29 has a slot 29*a* therein to permit said plate member 60 to slide therethrough at its inward position, said plate member will cover said hole 30. An angled bracket 63 is secured to and extends outwardly of said wall 20, the extended position 63***a* thereof is rod like having a pair of spaced notches 63*c* and 63*d* formed therein. Said stop member 60*c* will be positioned in said notches to respectively position said plate member 60 in position to cover or uncover said hole 30.

Mounted onto the bottom side 48*a* of said bottom support member 48 aligned respectively with each of said holes 30–34 are depending spouts as represented by spout 74.

Disposed about each of said spouts and secured in a conventional manner to said support member 48 are state of the art bag holding brackets as represented by bracket 70, the brackets respectively having operating arms as indicated by the arm 70*a* extending forwardly of the side wall 20 to operate said brackets for engaging or releasing bags 80, as the case may be. The bag holding structure is well known in the art and requires no further description.

A bag support 82 is provided having a leg supported base 83 and pairs of upstanding rods 85 and 87 at each end of said hopper, the same being disposed through accommodating apertures 88 through said end members 31 and 32, the same being secured by set screws 90. Thus said bag stand may be adjusted as to the height of the bag used to provide a bottom support.

The operation of the bag filling apparatus is believed to be clear from the description given. If all chutes are used simultaneously to fill bags, the individual cover plates are pulled outwardly to uncover the holes 30–34 and the elongated member 52 will be operated to open and close the bag filling chutes. Said holes 30–34 may be selectively covered to limit the number of bags to be filled at one time.

The apparatus is simple of construction and very efficient and convenient for use. It is readily portable as dump trucks are equipped for attachment of the apparatus described.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A portable bag filling apparatus, having in combination a supply hopper having a bottom wall and having in board downwardly inclined end walls and at least one side wall, said walls serving as deflection plates, said bottom wall having openings therein, a plurality of chutes discharging from said openings in said bottom wall, an elongated plate member apertured to have openings in register with said openings in said bottom wall in one position and out of register therewith in an alternate position, and transverse members disposed across said bottom of said hopper and respectively overlying said openings in said bottom and having openings in register with said openings in said bottom in one position and out of register therewith in an alternate position, and bag holding means carried by said chutes.

* * * * *